US006149092A

United States Patent [19]

Chen

[11] Patent Number: 6,149,092

[45] Date of Patent: Nov. 21, 2000

[54] YARN SUPPLY APPARATUS FOR KNITTING MACHINES

[76] Inventor: Jen Hui Chen, No. 775, Chung Cheng Rd., Su-Lin City, Taipei County, Taiwan

[21] Appl. No.: 09/328,377

[22] Filed: Jun. 9, 1999

[30] Foreign Application Priority Data

Sep. 23, 1998 [TW] Taiwan ..... 87215818

[51] Int. Cl.[7] ..... B65H 51/22

[52] U.S. Cl. ..... 242/366; 66/132 T

[58] Field of Search ..... 242/364.9, 365, 242/366; 66/132 R, 132 T

[56] References Cited

U.S. PATENT DOCUMENTS

| | | | |
|---|---|---|---|
| 4,271,687 | 6/1981 | Memminger et al. | 66/146 |
| 4,361,292 | 11/1982 | Fecker et al. | 242/366 X |
| 4,394,988 | 7/1983 | Hruby et al. | 242/366 |
| 4,489,899 | 12/1984 | Calamani et al. | 242/366 X |
| 4,793,565 | 12/1988 | Fecker . | |
| 4,890,464 | 1/1990 | Tsuchiya et al. | 66/132 T |
| 4,918,948 | 4/1990 | Nurk | 66/132 T |
| 5,802,881 | 9/1998 | Lin | 66/132 T |

*Primary Examiner*—Donald P. Walsh
*Assistant Examiner*—Collin A. Webb
*Attorney, Agent, or Firm*—Dougherty & Troxell

[57] ABSTRACT

A yarn supply apparatus for knitting machines is provided wherein an outgoing yarn guide eye set is disposed laterally adjacent to and lower than an underside of a yarn supply drum; a yarn pull-out section with a vertical circumferential surface is slightly inclined toward the circumference of the underside of the yarn supply drum such that when the yarn unwinding from the yarn supply drum the yarn will be vibrated upward and downward rapidly for being completely in contact with the circumferential surface of the yarn pull-out section so as to filter out dirt adhered on the yarn and nap accumulated on the circumferential surface of the yarn pull-out section. As a result, the manual cleaning work will be minimized.

1 Claim, 4 Drawing Sheets

YARN SUPPLY APPARATUS FOR KNITTING MACHINES

BACKGROUND OF THE INVENTION

1. Field of the Invention

The present invention relates to a yarn supply apparatus for knitting machines, and more particularly to a yarn supply apparatus for knitting machines having a yarn supply drum for scraping nap out of yarn and the circumferential surface of the yarn supply drum.

2. Description of Related Art

As known, a circular knitting machine comprises several hundred of yarn supply drums. The yarn can be drawn from a bobbin through the guiding of yarn guides to the knitting machine for knitting. However, it is inevitable for nap to be accumulated on the yarn supply drums and/or yarn guides when in high speed operation. It is found that nap is subject to being accumulated on the bottom of the yarn supply drum. It is known that a yarn consists of a plurality of twisted filaments. It is common for any single filament of the yarn to be broken in operation. As a result, yarn supply becomes difficult when such accumulation worsens. This is a problem that bothers many persons skilled in the art.

U.S. Pat. No. 4,793,565 discloses an apparatus for solving such a problem. As shown in FIG. 1, a free ring 27 is provided on the circumferential surface of the lower part of the yarn supply drum. The ring 27 is able to scrape the accumulated nap out of the lower part 24 of the yarn supply drum by means of vibration. However, the ring 27 is a circular shape, and the surface of the yarn supply drum is a cylindrical shape, and the lower section 23 of the yarn supply drum is a conical body. The yarn 8 is in tangent contact with a plurality of pins. The yarn 8, which is drawn out of the lower part 24 of the yarn supply drum, is inclined at an angle about 15 degrees with respect to horizontal. It is known that the contact of a circumference with a straight line is a point. This means that the contact area between the yarn 8 and the circumferential surface of the drum is very small. Further, it is not possible to scrape nap nor stop nap from being accumulated on the lower part 24 and the ring 27 because the lower section 23 is a conical body as mentioned above. Such design is unsatisfactory for the fulfilment of the requirement of high speed operation. Worse, it can impede the operating procedure.

Thus, it is desirable to provide a yarn supply apparatus for knitting machines without the drawbacks of the prior art.

SUMMARY OF THE INVENTION

It is therefore an objective of the present invention to provide a yarn supply apparatus for knitting machines having a yarn supply drum for scraping nap out of yarn and the circumferential surface of the yarn supply drum.

It is another objective of the present invention to provide a yarn supply apparatus for knitting machines wherein an outgoing yarn guide eye set is disposed laterally adjacent to and lower than the underside of the yarn supply drum; a yarn pull-out section with a vertical circumferential surface is slightly inclined toward the circumference of the underside of the yarn supply drum such that when the yarn unwinding from the yarn supply drum the yarn will be vibrated upward and downward rapidly for being completely in contact with the circumferential surface of the yarn pull-out section so as to filter out dirt adhered on the yarn and nap accumulated on the circumferential surface of the yarn pull-out section. As a result, the manual cleaning work will be minimized.

The above and other objectives, plus features and advantages of the present invention will become apparent from the following detailed description taken with the accompanying drawings.

DETAILED DESCRIPTION OF THE PREFERRED EMBODIMENTS

Figure 1:
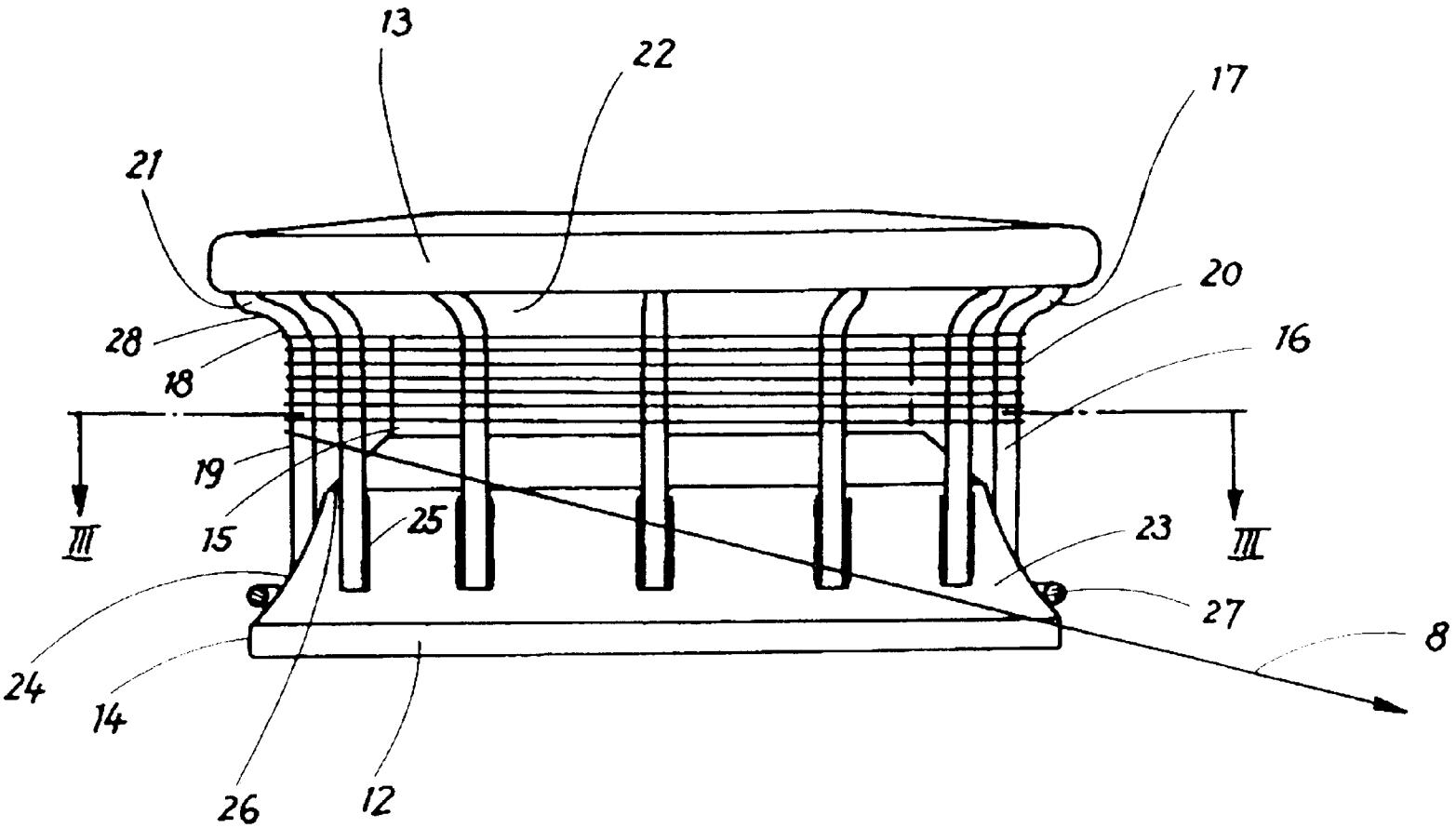
FIG. 1 (PRIOR ART)
FIG. 1 shows a side view of a prior art yarn supply drum for showing the direction of outgoing yarn.
Figure 2:
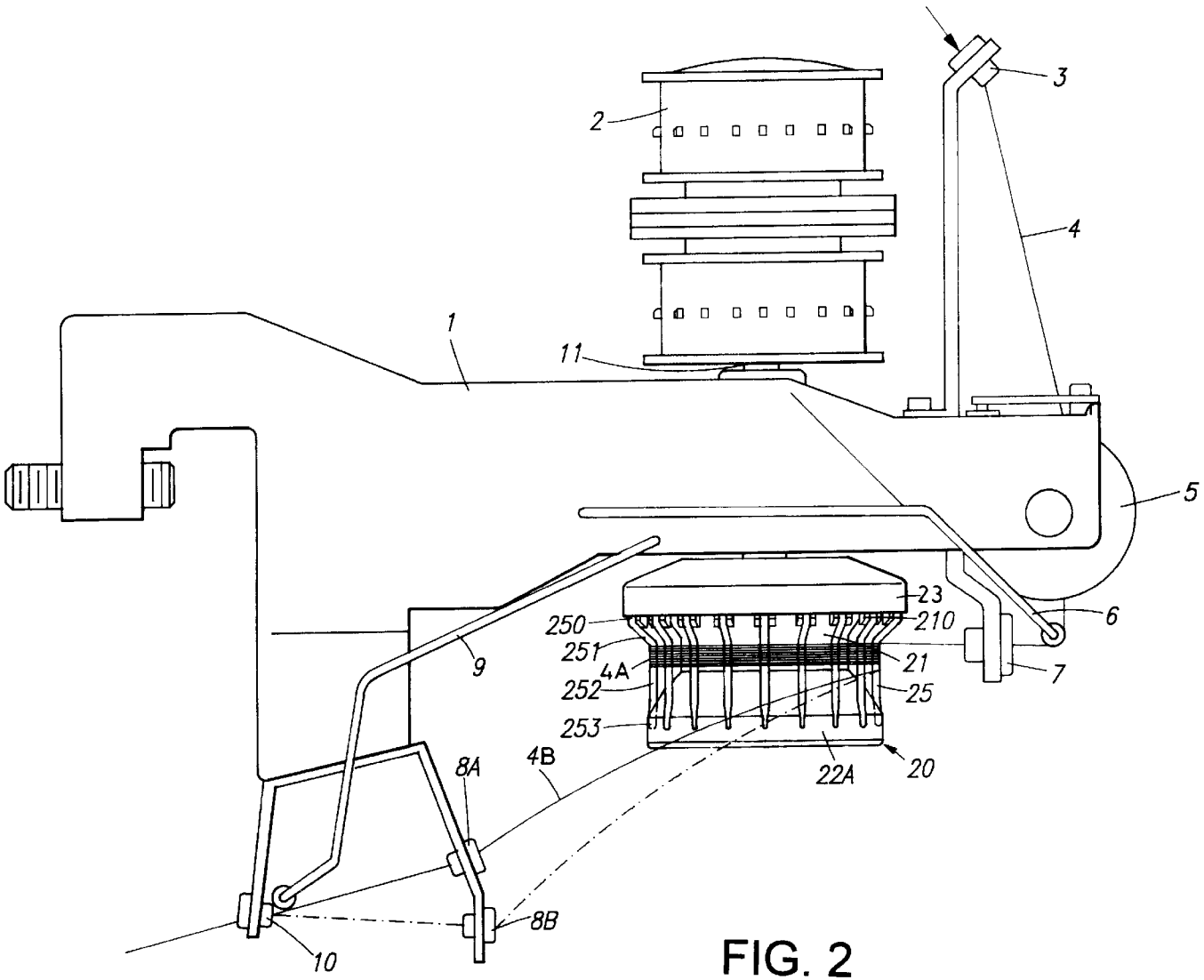
FIG. 2 shows a side view of the yarn supply apparatus of the present invention.
Figure 3:
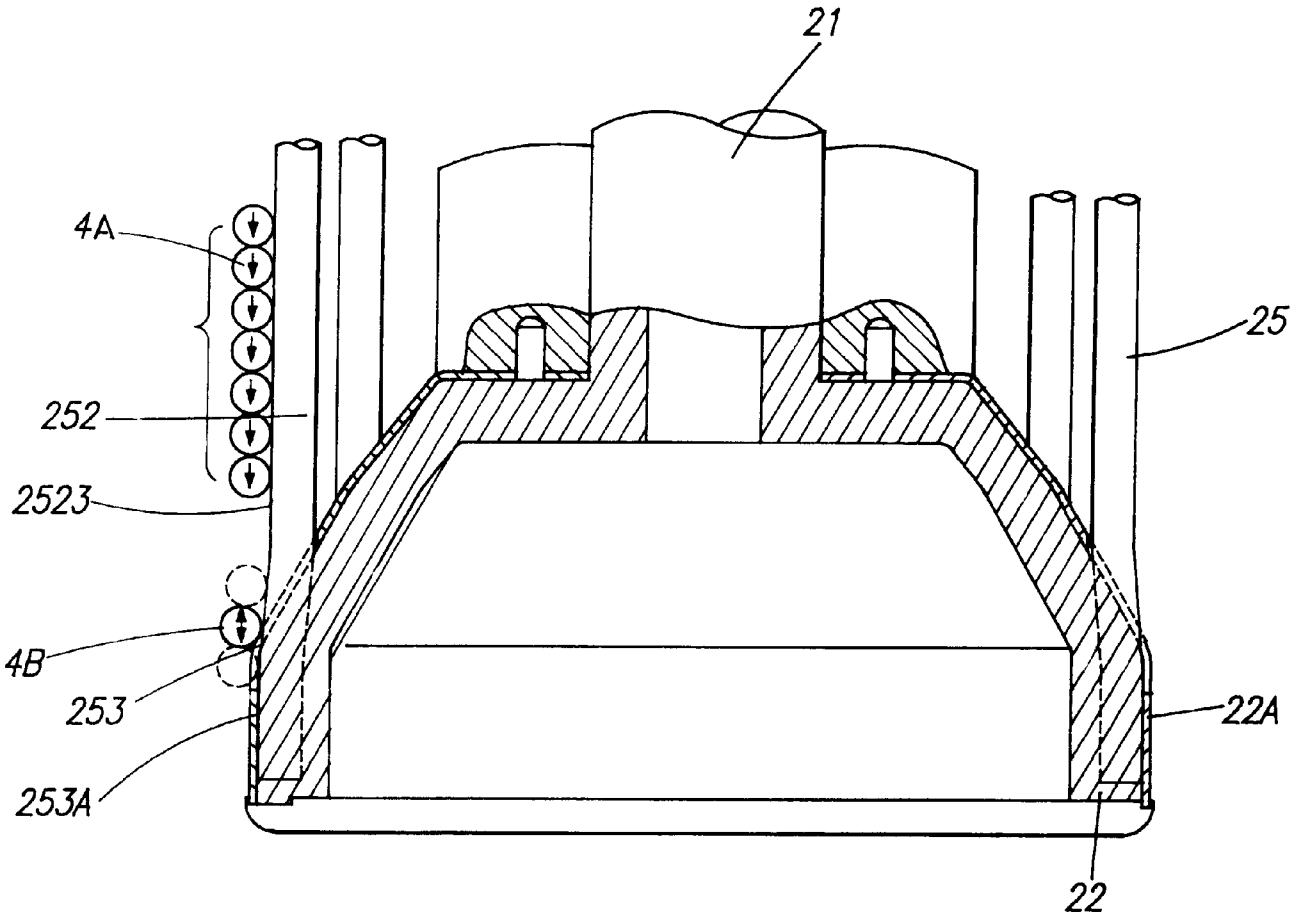
FIG. 3 is a detailed drawing of the lower part of the yarn supply drum for showing a metal pin slightly inclined outward and illustrating the contact between the metal yarn pull-out section and the circumferential surface of a plastic lower body of the yarn supply drum.
Figure 4:
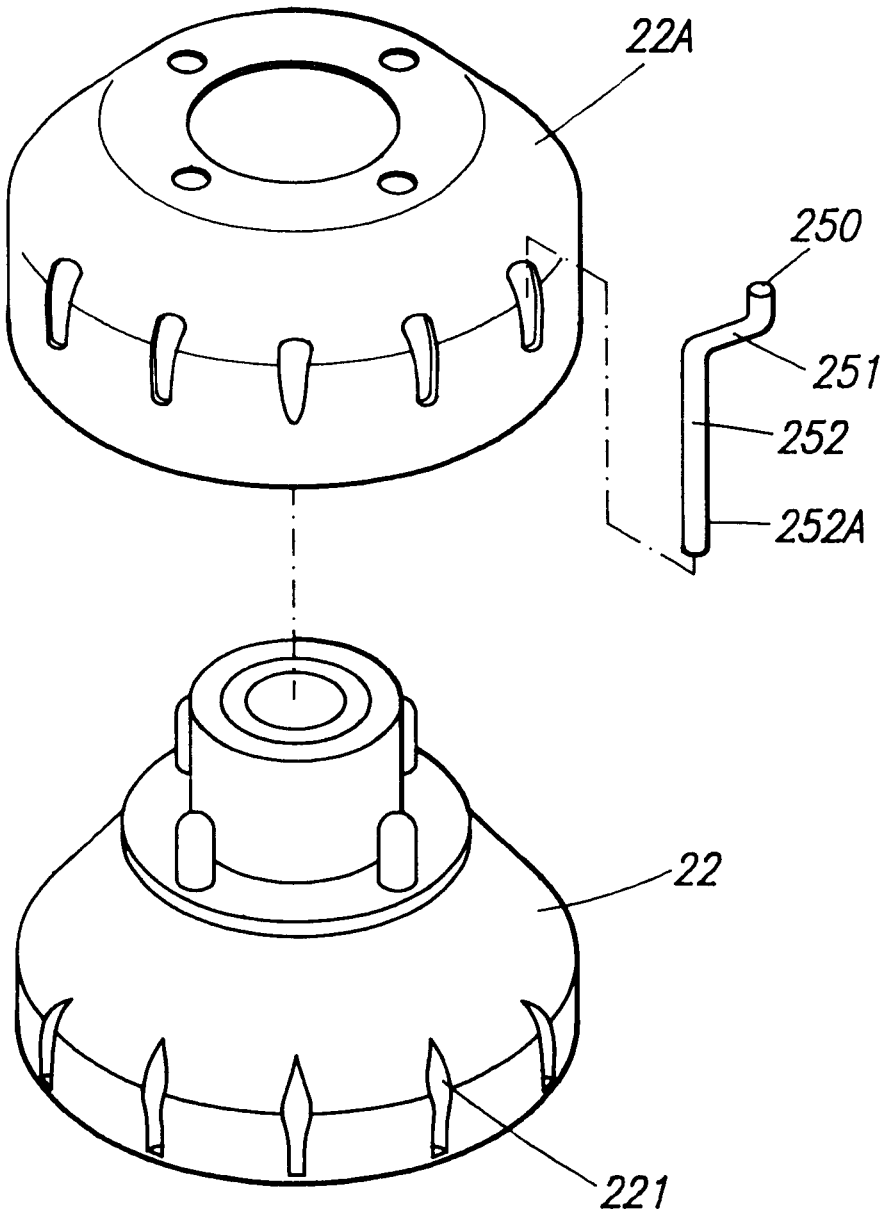
FIG. 4 is an exploded view of a metal housing and the plastic lower body.

Referring to FIGS. 2–4, the yarn supply apparatus comprises a body 1 disposed on a mounting fixture of the knitting machine (not shown), a belt pulley 2 disposed on the body 1, a drive shaft 11 of a motor (not shown), a yarn supply drum 20 disposed under the body 1 for being set in rotation synchronously with the belt pulley 2 by means of the drive shaft 11, a first incoming yarn guide eye 3, a yarn brake 5, an incoming yarn tension detector 6, a second incoming yarn guide eye 7, a first outgoing yarn guide eye set 8 comprising an upper yarn guide eye 8A and a lower yarn guide eye 8B, an outgoing yarn tension detector 9, and a second outgoing yarn guide eye 10.

The yarn 4 is guided from the yarn guide eye 3, the yarn brake 5, the yarn tension detector 6, the yarn guide eye 7, the yarn supply drum 20, the yarn guide eye set 8, the yarn tension detector 9, the yarn guide eye 10, and finally to the knitting machine for knitting.

The upper yarn guide eye 8A is suitable for short fiber yarn and/or less dirty yarn, while the lower yarn guide eye 8B is suitable for long fiber yarn. This is because the upper yarn guide eye 8A has a smaller friction force against the yarn 4A as compared with the friction force of the lower yarn guide eye 8B against the yarn 4B for filtering out the dirt adhered on the yarn.

The yarn supply drum 20 comprises an upper section 23, a cylindrical upper body 21, a generally conical lower body 22 with a metal housing 22A, and a plurality of circular pins 25 disposed axially parallel to each other generally around the upper body 21 and the lower body 22.

The pin 25 as shown in FIG. 4 comprises an end portion 250, a curved portion 251 for guiding the yarn 4, a standing portion 252 and another end portion 252A. The end portion 250 is anchored into the upper section 23. The standing portions 252 of the pins 25 serve the function of yarn storage when the yarn is wound around the pins 25. The standing portion 252 is slightly slanted toward the circumference of the underside of the yarn supply drum 20. The end portion 252A is anchored into a slot 221 of the lower body 250 through a hole 22A1 of the housing 22A.

The improvement of the yarn supply apparatus of the present invention is that a yarn pull-out section 253 in a generally cylindrical shape with a smooth wall section 253A is formed on the housing 22A. The yarn pull-out section 253 is slightly inclined toward the circumference of the underside of the yarn supply drum 20. The wall section 253A is generally perpendicular to the horizontal. The outgoing yarn guide eye set 8 is disposed laterally adjacent to and lower than the underside of the lower body 22. Further, the outgoing yarn 4A between the yarn supply drum 20 and the upper yarn guide eye 8A is inclined at an angle larger than 25 degrees with respect to the horizontal. It is designed that as the yarn 4 unwinds from the yarn supply drum 20 the yarn 4 will be vibrated upward and downward rapidly. Thus the yarn 4 will be completely in contact with the circumferential surface of the metal yarn pull-out section 253 so as to filter out dirt adhered on the yarn 4 and nap accumulated on the circumferential surface of the yarn pull-out section 253. Thereafter, dirt and nap will freely fall on the ground. It is noted that the yarn 4A is not in contact with the plastic lower body 22 such that there is no static electricity generated. The benefit is that the lower body 22 is protected from being damaged by the high speed rotation of the yarn 4A.

The following is the description of unwinding and scraping processes:

The yarn 4A wound on the standing portions 252 is continuously pushed down. The yarn 4A is pulled off from the standing portions 252 when the yarn 4A reaches a dividing point 2523 between the standing portion 252 and the yarn pull-out section 253. The yarn 4B is scraped by the yarn pull-out section 253, i.e., the yarn 4B is scraped through the circumferential surface of the yarn pull-out section 253. On the other hand, the yarn 4B is scraped by every pin 25. Further, the yarn 4B is scraped by the circumferential surface of the wall section 253A. The contact between the yarn 4B and the wall section 253A will not cause static electricity being generated. As mentioned above, dirt and nap will be scraped out of the yarn 4 and freely fallen on the ground.

In brief, the scraping of the yarn 4 of the present invention is from the dividing point 2523 to the lower end of circumferential surface of the wall section 253A, i.e., through a considerable portion of the circumferential surface of the yarn supply drum 20. In contrast, the scraping of the yarn 4 of the prior art is simply through the tangent contact of the yarn 8 with the pin, i.e., a point.

While the invention herein disclosed has been described by means of specific embodiments, numerous modifications and variations could be made thereto by those skilled in the art without departing from the scope of the invention set forth in the claims.

What is claimed is:

1. A yarn supply apparatus for knitting machines comprising:

a body;

a belt pulley disposed on the body;

a yarn supply drum disposed under the body and rotating synchronously with the belt pulley, the yarn supply drum comprising an upper body, a lower body with a housing, and a plurality of pins disposed axially parallel to each other generally around the upper body and the lower body; each of the pins comprising a first end portion, a curved portion for guiding yarn, a standing portion for storing yarn, and a second end portion; a yarn pull-out section in a generally cylindrical shape with a wall section formed on the housing; and an outgoing yarn guide eye set located such that outgoing yarn between the yarn supply drum and the outgoing yarn guide eye set is inclined at an angle larger than 25 degrees with respect to the horizontal;

wherein when the yarn unwinding from the yarn supply drum the yarn will be rapidly vibrated upward and downward for being completely in contact with the circumferential surface of the yarn pull-out section so as to filter out dirt adhered on the yarn and nap accumulated on the circumferential surface of the yarn pull-out section.

* * * * *